US007028375B1

(12) United States Patent
Schaefer

(10) Patent No.: US 7,028,375 B1
(45) Date of Patent: Apr. 18, 2006

(54) ATTACHMENT OF METAL AND PLASTIC PARTS OF AN IMPLEMENT HANDLE

(75) Inventor: Robert Schaefer, Tustin, CA (US)

(73) Assignee: Carrand Companies, Inc., Compton, CA (US)

( * ) Notice: Subject to any disclaimer, the term of this patent is extended or adjusted under 35 U.S.C. 154(b) by 0 days.

(21) Appl. No.: 11/019,573

(22) Filed: Dec. 22, 2004

(51) Int. Cl.
*B25G 1/04* (2006.01)

(52) U.S. Cl. ..... 16/427; 15/145

(58) Field of Classification Search ..... 16/108, 16/109, 429, 436, DIG. 41, 427; 403/13, 403/280, 14, 274; 285/93, 382, 256; 15/145; 29/505

See application file for complete search history.

(56) References Cited

U.S. PATENT DOCUMENTS 1,956,142 A * 4/1934 Brohasek et al. ..... 403/256
2,029,798 A * 2/1936 Schellin ..... 285/93
2,162,310 A 6/1939 Korson
3,606,406 A 9/1971 Walters
4,240,759 A 12/1980 Matsumoto et al.
4,285,096 A * 8/1981 Swaim ..... 16/422
4,683,610 A * 8/1987 Richards et al. ..... 16/429
4,792,256 A * 12/1988 Batchelor ..... 403/296
5,117,328 A * 5/1992 Bilodeau ..... 361/679
5,161,278 A 11/1992 Tomm
5,210,898 A 5/1993 Carey
5,226,198 A * 7/1993 Martin ..... 15/230.11
5,316,264 A 5/1994 Newman, Sr. et al.
5,336,012 A 8/1994 Newville
5,487,529 A 1/1996 Newville
5,584,594 A 12/1996 Newville (Continued)

FOREIGN PATENT DOCUMENTS

EP 782905 A2 * 7/1997

(Continued)

*Primary Examiner*—Chuck Y. Mah
(74) *Attorney, Agent, or Firm*—George R. McGuire; Bond, Schoeneck & King, PLLC

(57) ABSTRACT

A hollow, cylindrical, handle is substantially permanently connected to a end piece by insertion into the distal end of the handle of a first axial section of the end piece and inwardly deforming portions of the handle wall inwardly into indentations formed in the outer surface of the end piece. The end piece includes a shoulder at the juncture of the first section with a second section limiting the extent of insertion of the end piece into the handle and the indentations are formed, preferably on diametrically opposite sides of the first section, at a known axial distance from the shoulder. Visible indicia are placed on the outer surface of the second section in axial alignment with the indentations. The positions at which the handle wall is inwardly deformed is determined by the known distance from the shoulder (distal end of the handle) and in axial alignment with the indicia on the second section. In the disclosed embodiment, the indentations are elongated in a direction perpendicular to the central axis of the end piece and the visible indicia comprise flat surfaces in planes parallel to the central axis in an otherwise generally cylindrical outer surface of the second section. An O-ring provides a seal between the handle and end piece and the latter is formed with a through bore in applications where a liquid is to be supplied to an applicator or other tool mounted on the end piece.

14 Claims, 3 Drawing Sheets

U.S. PATENT DOCUMENTS 5,606,790 A * 3/1997 Laue ..... 29/517
5,623,890 A * 4/1997 Lenske ..... 116/205
6,006,399 A 12/1999 Massaro
6,045,284 A 4/2000 Chiu
6,254,305 B1 7/2001 Taylor
6,293,726 B1 * 9/2001 Wolf ..... 403/299
6,427,289 B1 * 8/2002 Flanz ..... 16/433
6,481,764 B1 * 11/2002 Kwok ..... 285/382
6,640,457 B1 * 11/2003 Williams et al. ..... 33/501.45

FOREIGN PATENT DOCUMENTS

GB 1406181 A * 9/1975
JP 10281131 A * 10/1998

* cited by examiner

ATTACHMENT OF METAL AND PLASTIC PARTS OF AN IMPLEMENT HANDLE

BACKGROUND OF THE INVENTION

The present invention relates to the attachment of an elongated, tubular, metal handle to a plastic end portion which serves as a support for an applicator, such as a sponge, mop, spray device, or other tool or implement. More specifically, the invention relates to a novel and improved physical attachment means for securing an elongated handle to a metal end piece, and to a method of attachment of such a handle and end piece.

Many types of cleaning implements, as well as other tools, are equipped with an elongated handle which is grasped by the user to manipulate the device carried on the distal end of the handle. Such implements include those wherein a liquid, such as water or a cleaning solution, is supplied to the proximal end, or other portion, of a hollow, metal handle and flows through the handle to be discharged at the distal end, often through an applicator which is removably mounted to a plastic end piece of the handle. The end piece is physically connected to the handle, for example, by rivets or other connectors. This means of attachment risks cracking or other damage to the end piece, as well as possibly creating leaks of the solution which flows through the handle during use.

It is an object of the present invention to provide an article of manufacture wherein an elongated, hollow, handle and a metal end piece are mutually joined by novel and improved structure.

Another object is to provide means for securely attaching a metal end piece to one end of an elongated handle of a manually manipulated cleaning implement without substantial possibility of damage to the end piece in the attachment process.

A further object is to provide a novel and improved method of attaching a metal end piece to one end of a tubular handle.

Still another object is to provide an elongated, hollow, implement handle with a metal end piece secured by novel and advantageous method and means to one end of the handle with provision for supply of liquid through the handle and end piece to an implement mounted to the end piece.

Other objects will in part be obvious and will in part appear hereinafter.

SUMMARY OF THE INVENTION

The connected handle and end piece of the invention are advantageously applied in the field of cleaning implements wherein an applicator such as a sponge, mop, or the like is detachably mounted upon the end piece, for example, by a threaded connection, and water or other cleaning liquid is supplied through the hollow handle and a likewise hollow end piece to the implement. Consequently, the invention will be described in such an application, although it will be understood that it is susceptible to other applications and the scope of the invention is to be limited only by the appended claims. For example, the connected handle and end piece may be employed in applications which do not employ the supply of fluid through a hollow handle and end piece and thus do not require a hollow end piece or liquid tight sealing means.

The handle itself is of conventional, hollow, tubular, construction, of uniform inner and outer diameter and appropriate length for the intended use of the implement to which it is attached. The end piece is of rigid, metal and includes a cylindrical base section having an outer diameter equal to or slightly smaller than the inner diameter of the handle. A resilient a-ring is carried in a groove on the outer surface of the base section. An intermediate section, preferably having a tapered or curved outer surface, connects the base section to a tip section having a molded thread for mating engagement with threads on an applicator or other such implement to be manipulated by a user gripping the handle. Normally the threads on the end piece will be external and those on the implement internal, although the nature of the mutual engagement means is not critical to employment of the invention. The end piece has a through bore, at least in constructions which are intended for supply of liquid through the handle and end piece.

A pair of indentations are formed in the outer surface of the base section, preferably on diametrically opposite sides thereof. In the disclosed embodiment, the indentations are elliptical in shape and are positioned between the O-ring and the junction of the base and intermediate sections. A pair of visible indicia are formed in or applied to the intermediate section in axial alignment with the indentations in the base section. In assembly, the base section is inserted into the open, distal end of the handle until the end of the handle contacts a shoulder at the junction of the base and intermediate sections. Although the indentations in the base section are now hidden inside the handle, their location is known from the positions of the indicia on the intermediate section and the known axial distance from the shoulder to the indentations. Thus, the wall of the handle may be struck or squeezed at the appropriate positions to deform portions of the handle into the indentations in the base section, providing an essentially permanent connection of the handle and end piece.

The foregoing and other features of construction and method of connection of the invention will be more easily understood and fully appreciated from the following detailed disclosure, taken in conjunction with the accompanying drawings.

DETAILED DESCRIPTION

Figure 1:
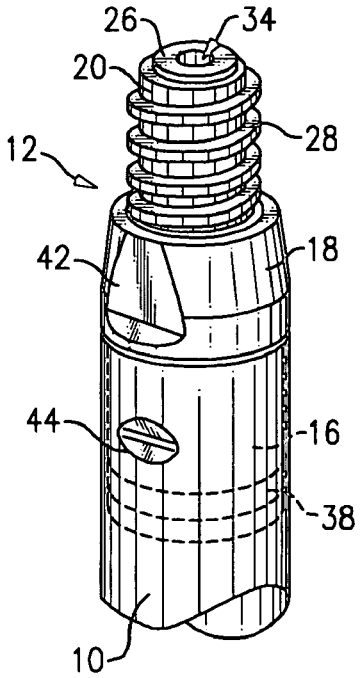
FIGS. 1 and 2 are perspective views, shown from a first side, of the end piece and distal end of the handle after and before, respectively, insertion of the end piece and deformation of the handle.

The structural elements of the invention are a tubular, handle 10 and a metal end piece 12. Handle 12 is hollow and open at distal end 14, having a wall thickness sufficient to provide the required degree of rigidity and strength, and a length between distal end 14 and a proximal end (not shown) appropriate to the intended application wherein the implement is employed. The outer and inner diameters of handle 10 are uniform, at least in the region adjacent distal end 14, which lies in a plane normal to the central axis of handle 10.

End piece 12 is preferably manufactured as a unitary member from a deformable metal plastic such as aluminum. The end piece includes three sections, namely, base section 16, intermediate section 18 and tip 20. Base section 16 extends from what is termed the lower end 22 of end piece 12 to a junction with intermediate section 18 at shoulder 24. Intermediate section 18 extends from base section to tip 20, which extends to top end 26. Thread 28 is integrally molded on the outer surface of tip 20 for engagement with internal threads in an applicator or other implement (not shown) to be manually manipulated by a user grasping handle 10. The end piece and implement may be releasably joined by detent means or other such forms of mutual attachment.

Figure 5:
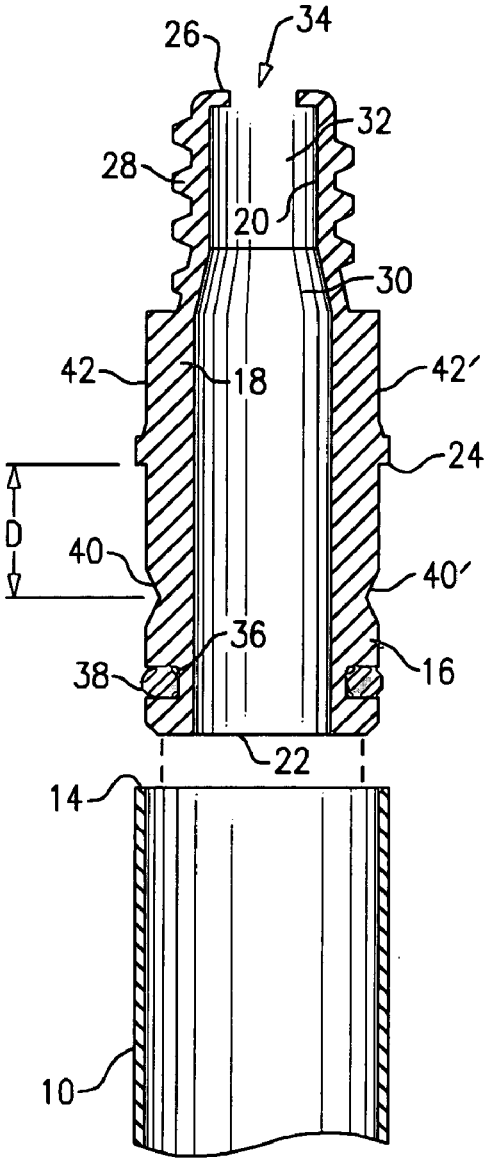
FIGS. 5 and 6 are elevational views, in section, of the end piece and distal end of the handle before and after, respectively, insertion of the end piece into the handle and deformation of the handle.
Figure 6:
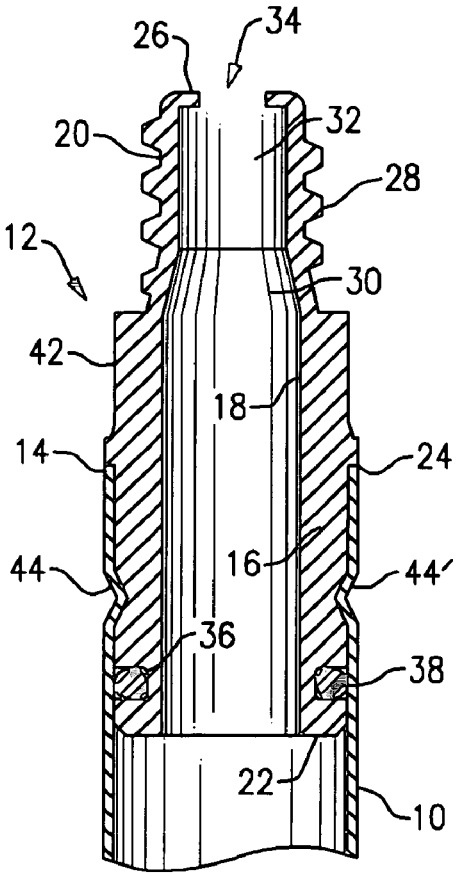

At least in applications intended to supply liquid through the handle and end piece to an attached implement, end piece 12 is formed with a through bore, as shown in FIGS. 5 and 6. Base section 16 and intermediate section 18 are of uniform inner diameter; tip 20 has a first inner portion 30 tapering inwardly to connect with second inner portion 32 and thence to smaller diameter opening 34 in end 26. Peripheral groove 36 is formed in the outer surface of base section 16 near lower end 22 to accommodate resilient O-ring 38 which, upon assembly 4 of handle 10 and end piece 12 provides a liquid-tight seal between the inner wall of the handle and the outer wall of the end piece.

Figure 2:
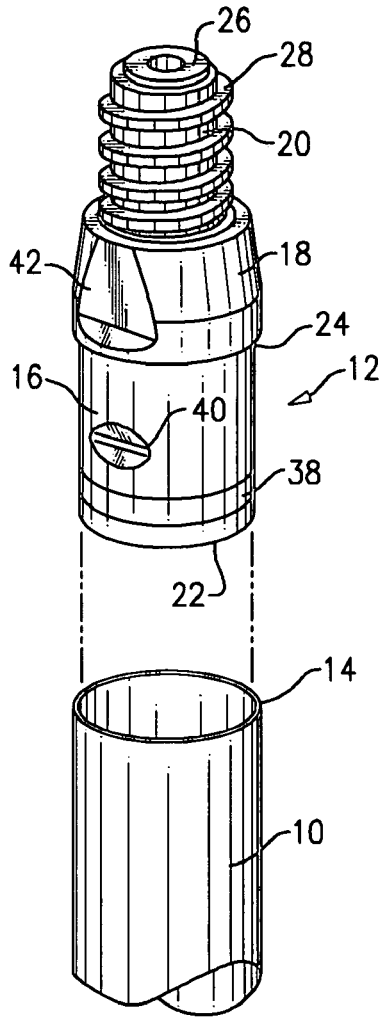
Figure 3:
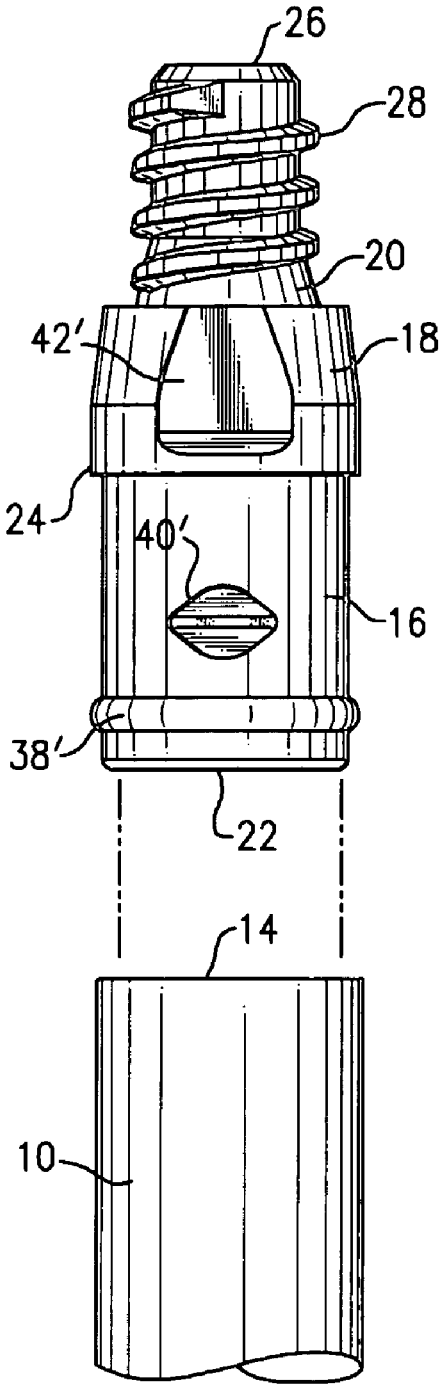
FIGS. 3 and 4 are elevational views of the end piece and distal end of the handle, shown from a second side, before and after, respectively, insertion of the end piece and deformation of the handle.
Figure 4:
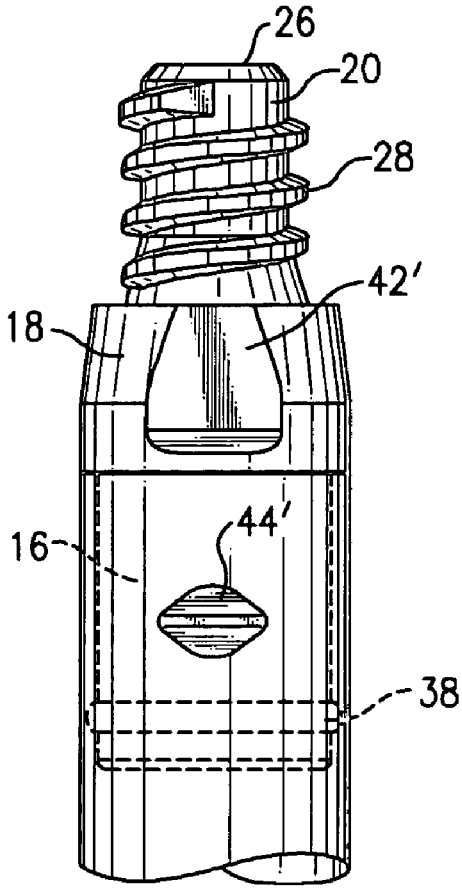

A pair of notches or other type of indentation are formed in the outer surface of base section 16. One of the indentations, denoted by reference numeral 40, is seen in FIGS. 1 and 2, while the other indentation, located at a position diametrically opposite indentation 40, is seen in FIGS. 3 and 4, denoted by reference numeral 40'. In the illustrated embodiment, indentations 40 and 40' have elliptical outlines, tapering outwardly on opposite sides of the central, deepest part of the indentation which extends perpendicularly to the central axis of the end piece. A second pair of notches, or other means creating visual indicia at predetermined positions, are formed in or applied to the outer surface of intermediate section 18. In the illustrated embodiment, the notches are formed as flat surfaces 42 and 42' in planes parallel to the central axis of end piece 12 on diametrically opposite sides of the tapering outer surface of intermediate section 16. Flats 42 and 42' are in axial alignment with indentations 40 and 40', respectively.

Base section 16 has a uniform outer diameter equal to or slightly smaller than the inner diameter of handle 10, permitting insertion of end piece 12 into the open distal end 14 of handle 10, from the position of FIGS. 2 and 3 to that of FIGS. 1 and 4, with a-ring 38 being resiliently deformed into sealing engagement with the inner wall of the handle. The extent of insertion is limited to the axial length of base 16 by contact of shoulder 24 with end 14. After insertion, the wall of handle 10 is struck or otherwise inwardly deformed at positions outwardly adjacent indentations 40 and 40' so that the metal of the handle extends into the indentations in the areas indicated at 44' in FIG. 6. After insertion, of course, the indentations are no longer visible, but the correct positions for inward deflection of the metal handle may easily be determined by the known axial distance from shoulder 24 to the indentations, indicated in FIG. 5 by dimension D, and by axial alignment with flats 42 and 42'. The outward appearance of deformations 44 and 44' is essentially the same as that of indentations 42 and 42', as will be noted from FIGS. 1-4.

What is claimed is:

1. An article of manufacture comprising:

a) an elongated, hollow handle having proximal and distal ends, and a cylindrical wall of uniform inner and outer diameters, at least adjacent said distal end;

b) an end piece having a central axis, a first axial portion extending into said distal end of said handle and a second axial portion extending outwardly from said distal end, said first portion having a cylindrical outer diameter no greater than said handle inner diameter, and at least one indentation extending into said first portion, and said second portion bearing visible indicia that are visually distinctive from the remainder of said end piece and bearing a predetermined, physical relationship to the position of said indentation; and c) at least a portion of said handle wall extending inwardly into said indentation to physically maintain said handle and end piece in mutually assembled relation.

2. The article of claim 1, further comprising said handle wall including first and second wall portions, wherein said first portion of said end piece includes two of said indentations and said first and second wall portions respectively extend into each of said indentations and said visible indicia appear on said second portion of said end piece in axial alignment respectively with each of said indentations.

3. The article of claim 2 wherein said indentations are on diametrically opposite sides of said first portion.

4. The article of claim 3 wherein said indentations are elongated in a direction perpendicular to said central axis.

5. The article of claim 4 wherein the configurations of said first and second wall portions on said handle wall are substantially identical to the configurations of said indentations.

6. The article of claim 5 wherein said second portion of said end piece is generally cylindrical and said visible indicia comprises flat surfaces in planes parallel to said central axis.

7. The article of claim 1 wherein said end piece is generally cylindrical and has a through bore.

8. The article of claim 7 and further including sealing means forming a liquid-tight seal between said end piece and said handle.

9. The article of claim 8 wherein said sealing means comprise a resilient O-ring.

10. The article of claim 9 and further including stop means limiting the extent of insertion of said first portion of said end piece into said handle.

11. The article of claim 10 where said stop means comprises an annular shoulder having a diameter greater than said handle inner diameter at the junction of said first and second portions of said end piece.

12. The article of claim 7 wherein said end piece further comprises a third portion extending axially outwardly from said second portion and having attachment means for removably mounting a tool to said end piece.

13. The article of claim 12 wherein said attachment means comprises threads for engagement with mating threads on said tool.

14. The article of claim 1 wherein at least one of said visible indicia of said second portion of said end piece is in axial alignment with said at least one indentation.

* * * * *